US005090215A

United States Patent [19]

Giesler et al.

[11] Patent Number: 5,090,215

[45] Date of Patent: Feb. 25, 1992

[54] APPARATUS FOR THE DISPOSAL OF COOLING AGENT OF ABSORPTION-TYPE REFRIGERATING SYSTEMS

[75] Inventors: Rolf-Dieter Giesler, Kreuztal; Volker Muller, Hilchenbach-Allenbach; Karl-Gösta Almén, Siegen, all of Fed. Rep. of Germany

[73] Assignee: Electrolux Siegen GmbH, Siegen, Fed. Rep. of Germany

[21] Appl. No.: 615,895

[22] Filed: Nov. 20, 1990

[30] Foreign Application Priority Data

Nov. 28, 1989 [DE] Fed. Rep. of Germany ..... 3939296

[51] Int. Cl.[5] ..... F25B 43/04; F25B 47/00

[52] U.S. Cl. ..... 62/475; 62/85; 62/149

[58] Field of Search ..... 62/476, 85, 195, 475, 62/149, 272, 292

[56] References Cited

U.S. PATENT DOCUMENTS

| | | | |
|---|---|---|---|
| 1,513,172 | 10/1924 | Hill | 62/475 |
| 2,327,081 | 8/1943 | Walters | 62/475 |
| 2,510,737 | 6/1950 | Buffington | 62/475 |
| 2,972,235 | 2/1961 | Smith | 62/475 |
| 3,896,633 | 7/1975 | Moore | 62/85 |
| 4,242,885 | 1/1981 | Quack et al. | 62/500 |
| 4,476,688 | 10/1984 | Goddrard | 62/475 |
| 4,984,431 | 1/1991 | Mount et al. | 62/475 |

FOREIGN PATENT DOCUMENTS

| | | | |
|---|---|---|---|
| 2202540 | 7/1973 | Fed. Rep. of Germany | 62/476 |

*Primary Examiner*—Albert J. Makay
*Assistant Examiner*—William C. Doerrler
*Attorney, Agent, or Firm*—Pearne, Gordon, McCoy & Granger

[57] ABSTRACT

Apparatus for removing and disposing of waste of absorption systems comprising a first and a second adapter for providing connection to the refrigerating system to be emptied; a compressor or compressor connection being connected to the first adaptor via a conduit for compressed air and a valve; a first pressure vessel being in connection with the adapters via pressure pipes and relating valves and having an outlet with a valve for the liquid accumulated in the first pressure vessel; a second pressure vessel connected to the first pressure vessel or tank via a pressure pipe and comprising a fresh water supply, a waste air pipe as well as an outlet with a valve, wherein the pressure pipe starting from the top end of the first pressure vessel leads into the lower half of the second pressure vessel; as well as at least one pressure gauge and a pressure-relief valve on one of the pressure vessels.

9 Claims, 5 Drawing Sheets

APPARATUS FOR THE DISPOSAL OF COOLING AGENT OF ABSORPTION-TYPE REFRIGERATING SYSTEMS

BACKGROUND OF THE INVENTION

The invention relates to an apparatus for removing and disposing of waste of absorption-type refrigerating systems in a manner accounting for requirements of environmental protection.

Starting with the realization that the fluorochlorohydrocarbons used as cooling agents in compressor-operated systems represent a danger for the environment, because they may damage the ozonosphere, refrigerating apparatus are considered as being critically dangerous waste which has to be duly disposed of in controlled manner. Operative evacuation systems, in which the cooling agent is collected and delivered to recycling processes, have been developed for compressor-operated refrigerating systems in which the cooling agent to the greater part is fluorochlorohydrocarbon R12.

Beside compressor-operated refrigerating systems there also exist refrigerating systems of different types which are based on the absorption principle. It is not possible to effect disposal of waste in case of those refrigerating systems using the techniques developed for compressor-operated refrigerating systems. For this reason large numbers of refrigerating apparatus of the absorption type pile up in the dumping grounds of municipal waste disposal and of professional waste disposal enterprises.

In usual absorption-type refrigerating systems, like those which are primarily used in hotels, catering services and for camping appliances, but which are also in addition used in households, the refrigeration process cycle is operated using a mixture from ammonia, water and auxiliary gas. Mainly hydrogen or helium, respectively, is used as pressure-compensating auxiliary gas. For reason of protection against corrosion substantial amounts of $Na_2CrO_4$ are added as corrosion inhibitor. In general absorption-type refrigerating apparatus contain about 250 g to 700 g of cooling agent of the following composition:

| 32–35 percent by volume ammonia ($NH_3$) | 2 percent by volume $Na_2CrO_4$ | distilled water ($H_2O$) |
|---|---|---|
| 80–245 g | 5–14 g | 165–441 g |

and minor amounts by weight of hydrogen or helium. Among these substances ammonia and chromate have to be considered as being detrimental to the environment.

The cooling agent in absorption-type refrigerating apparatus is under increased pressure, usually up to 25 bar. In contrast to the cooling agent contained in a compressor-type apparatus it does not evaporate in case of pressure relief but remains in liquid state in the now open refrigerating system. The ammonia contained in the refrigerating system is eagerly absorbed by the water; at 20° C. 100 ml of water dissolve about 52 g of $NH_3$. For this reason even in case of leakiness the greater portion of the ammonia can remain in the watery solution of the refrigerating system.

In spite of the fact that ammonia even in natural processes often is created and has a comparatively low toxicity, detrimental effects to health may be caused by larger concentrations, this indicating that a regular disposal and evacutation is required.

As compared thereto, the sodium chromate also contained in the refrigerating system represents a substantially higher risk. Compounds containing chrome, and in particular chromates, are known as being highly carcinogenic, and in case of frequent contact therewith may cause severe allergies. The sodium chromate contained in the refrigerating system of an absorption-type apparatus, however, in case of leakage also remains in the refrigerating apparatus.

Irrespective of the fact whether the refrigerating system in absorption-type apparatus is under pressure or without pressure, it is absolutely necessary to subject the cooling agent contained in the refrigerating system to a regular disposal. Up-to-now there is an absolute lack in suitable plants for such disposal.

In the disposal of the liquid still contained in the refrigerating unit two main problems arise. On one hand it is troublesome to remove the liquid from the refrigerating apparatus; even the application of a vacuum or a multiple perforation of the pipe do not lead to a complete evacuation. On the other hand the content of chromates requires particular attention. When an absorption-type system being under pressure is opened, during pressure relief at first aerosols containing chromate are created, which contain the chromate in tiny little droplets (some $\mu$m) which cannot be separated from the waste gas stream without problems. Similar aerosols also come into existence during blowing-out of the refrigerating apparatus with compressed air or another similar agent. Due to the small droplet size and, thus, to the hardly present inertial behaviour of these particles it is neither possible to achieve a sufficient separation by means of simple waste gas deviation and the arrangement of baffle elements. The existing threshold limit value (MAK) of 100 mg/m$^3$ for Cr cannot be met using traditional methods. In addition, this threshold limit value (MAK) for Cr in may cases is regarded as being too high, so that a further reduction of the value in the future cannot be excluded.

SUMMARY OF THE INVENTION

It is, therefore, the main object of the present invention to provide a secure removal and disposal of absorption-type apparatus which contain a still undamaged or a pressureless refrigerating unit.

This object is solved by an apparatus for evacuating and disposing of the coolant of absorption-type refrigerating systems, the cooling agent of which contains an auxiliary gas, water as solvent as well as a corrosion inhibitor, comprising a first and a second adapter for connection of the refrigerating system to be emptied, an air compressor or pressurized air connection member connected to said first adapter via a blockable pressurized air pipe and a relating valve, a first pressure vessel being in connection with said second adapter via a blockable pressure pipe and relating valves and comprising an outlet with a valve for the liquid collected in the vessel, a second pressure vessel connected to said first pressure vessel via a connection pipe and comprising a fresh water supply, a waste air pipe as well as an outlet with a valve, wherein said connection pipe starting from the top end of said first pressure vessel ends into the lower half of said second pressure vessel and wherein for emptying the refrigerating system said second pressure vessel is filled with water up to about one half and the valves are opened.

Preferred embodiments of the present invention are subject matter of the subclaims which are included into the specification by reference. The embodiments will in the following be described with reference to the drawings.

LIST OF FIGURES

Figure 2:
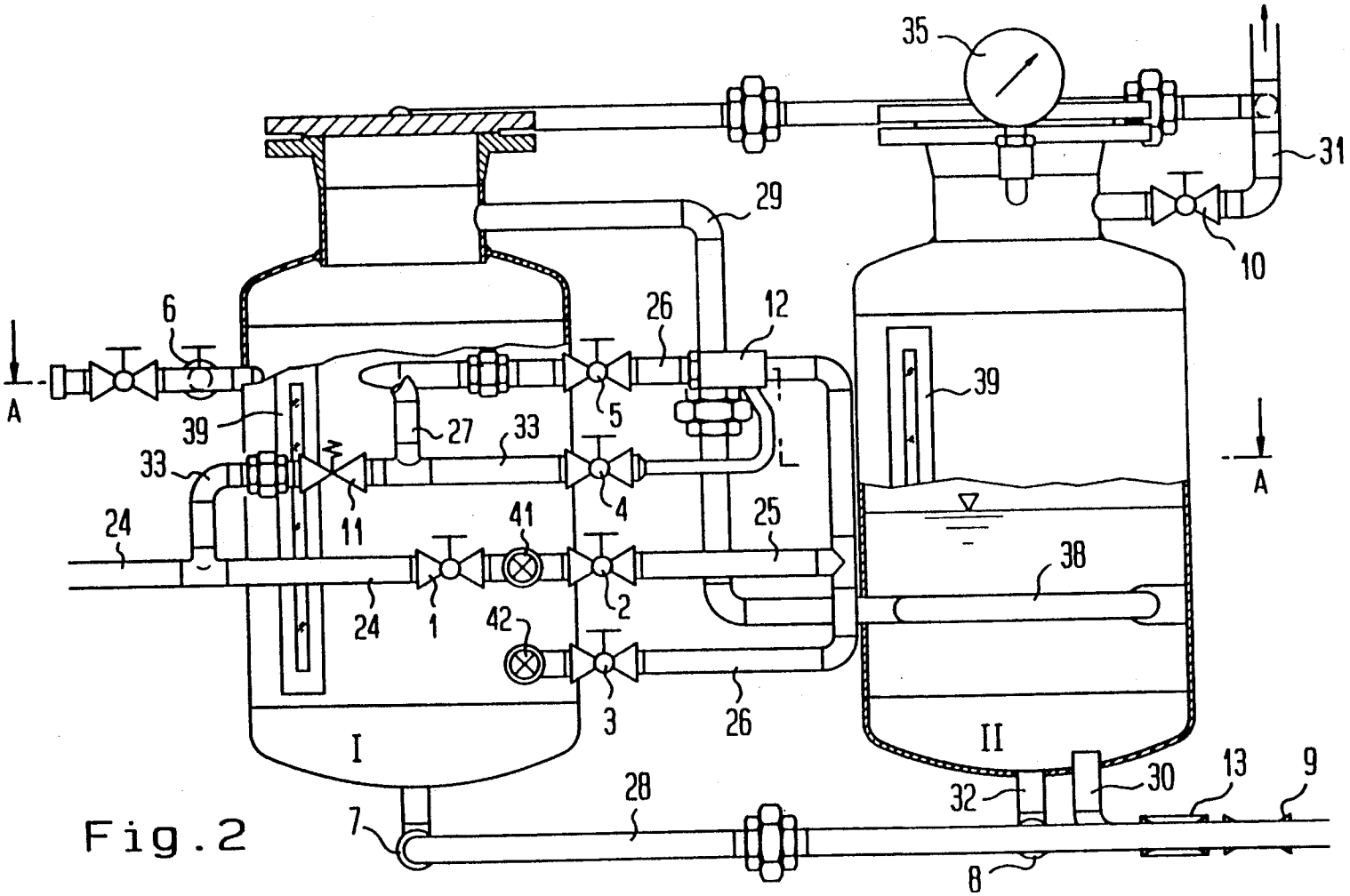
FIG. 2 is a view of the pressure vessel system.
Figure 3:
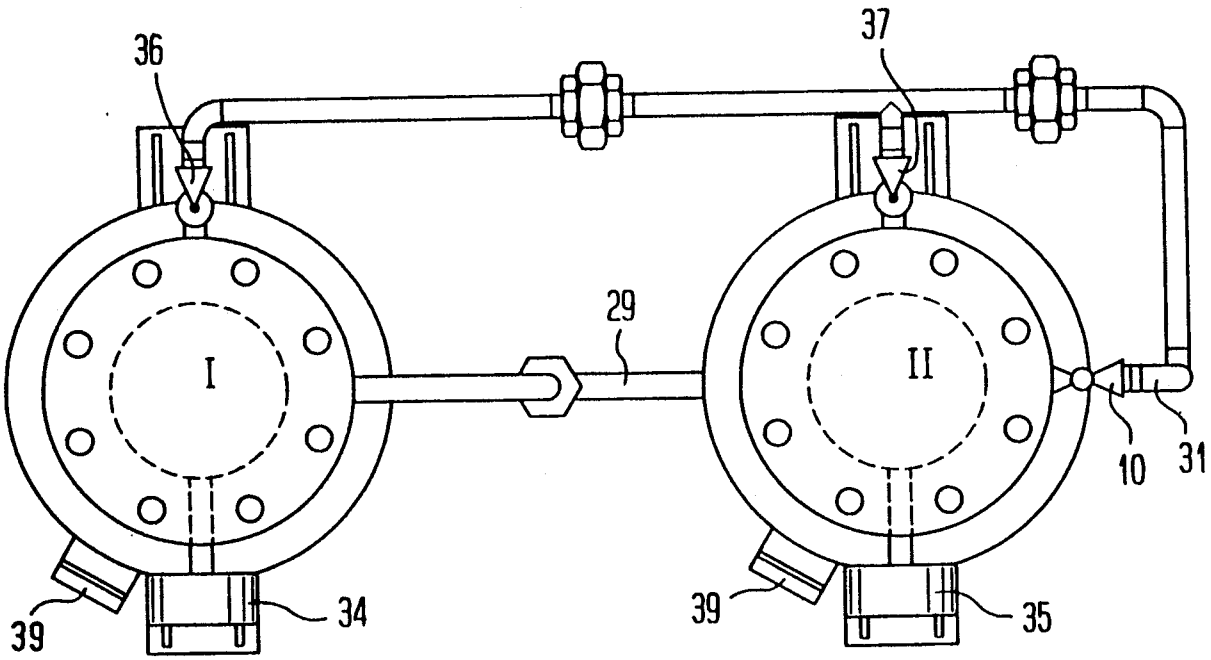
Figure 4:
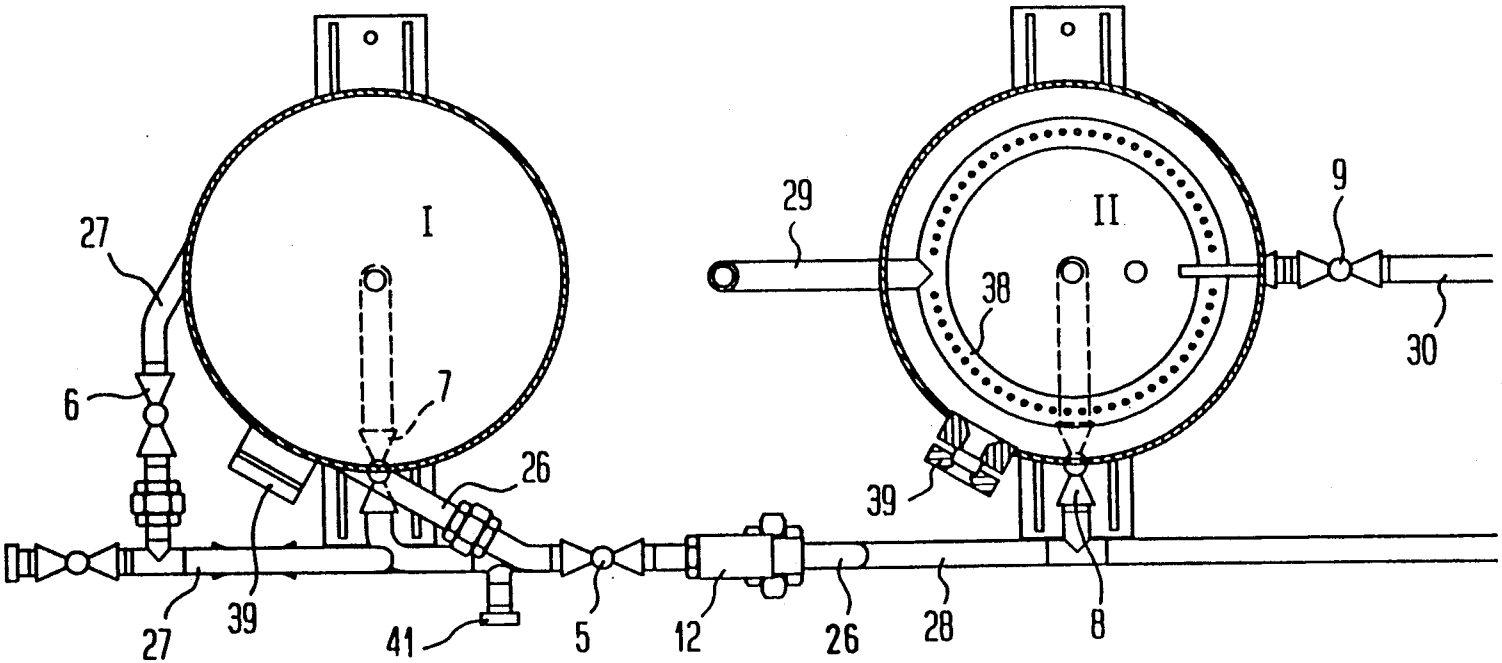

FIG. 3 a top view on the pressure vessel system of FIG. 2;

FIG. 4 a section through the pressure vessel system of FIG. 2; and

Figure 5:
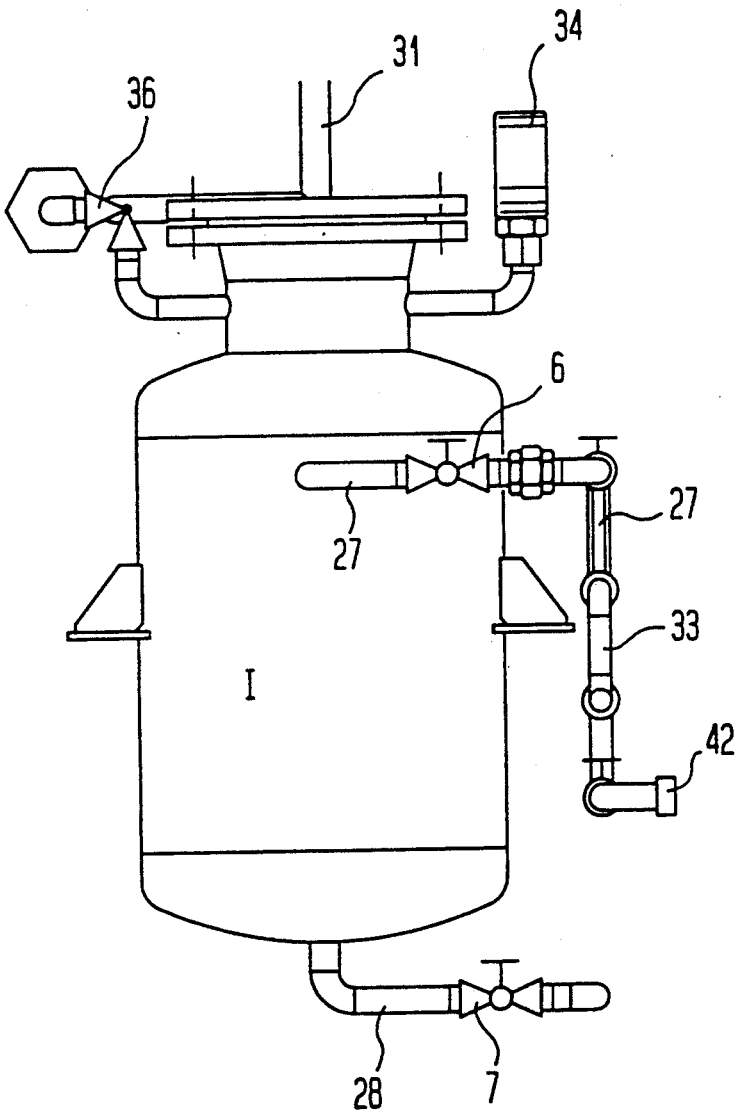

FIG. 5 a side view of the plant of FIG. 2.

DETAILED ACCOUNT OF WORKING EXAMPLE OF THE INVENTION

According to a preferred embodiment of the plant according to the present invention, said plant essentially consists of two pressure vessels disposed on a mobile base unit and being incorporated into a particular pipeline or tubing structure. Each tank is provided with a safety valve being on the blowoff side connected to the exhaust air chimney via a pipeline system as well as via a level indicator. Said level indicator may also be an inspection glass in the tank wall.

The respective actual tank pressure is indicated by means of at least one pressure gauge on one of the vessels. In operating condition the vessel II has a water supply, filling it preferably to about one half. For filling a corresponding pipe is provided, having a valve and preferably also a backstroke safety member; for reason of the increased pressure in the vessel in operating condition it is advisable to apply measurements preventing a return flow of the filling from the vessel II back into the water supply network. For this purpose a so-called tube separation element is particularly suitable.

The plant comprises two pressure hose pipes with special adapters for the connection to the refrigerating units. Said adapters should be dimensioned as to be suitable for tube diameters of 16 mm to 20 mm. Corresponding adapters are described in the applicant's parallel application (West German patent application P 39 39 248.1) having the same filing date. Said hose pipes are connected with the pressure vessel plant. A connection for pressurized air is provided at vessel I for blowing-out of the refrigerating units.

Figure 1:
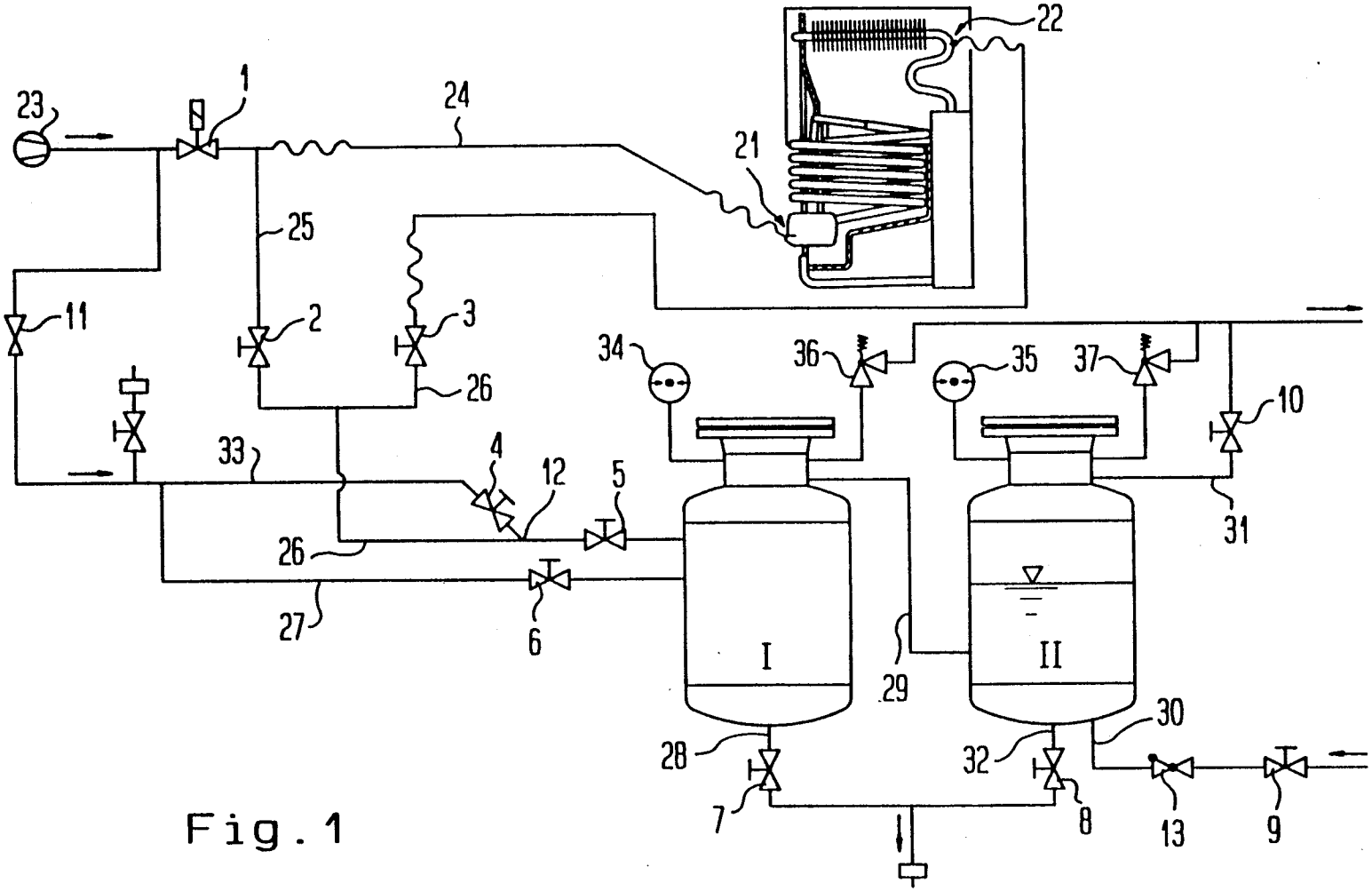
FIG. 1 shows a schematic view of a plant according to the present invention.

FIG. 1 shows a preferred embodiment of the plant according to the present invention comprising a first pressure vessel I and a subsequently connected pressure vessel II, both being connected by a connection pipe 29. The connection pipe 29 starts in the top portion of pressure vessel I and ends in the lower half of pressure vessel II. The pressure vessel II is filled with water to about one half so that said pipe 29 ends below the water level.

Both pressure vessels comprise pressure gauges 34, 35 as well as pressure-relief valves 36, 37 being connected to the exhaust air pipe 31 through pipelines. By means of such arrangement it is avoided that, in case of unprofessional handling or malfunctioning, deleterious gases pass into the space where the plant is located, and endanger the staff. The exhaust air pipe 31 starts in the upper half of the vessel II; it can be sealed by a valve 10. Both pressure vessels further comprise drain pipes 28, 32 with drain valves 7, 8, said pipes leading to a pipe to a container for collection of coolant to be disposed of. The vessel II is further connected to a fresh water supply via a pipe 30 and a valve 9. Preferably, a check valve 13 is located in said pipe.

The vessel I has connections for a separate pressurized air pipe 27 with a valve 6 as well as a pipe 26 with a valve 5 for the cooling agent to be disposed of. The pressurized air pipe 27 is fed via a compressor 23 delivering pressurized air of preferably about 18 bar, and via a throttle-type valve 11 with pressurized air of about 7 bar. In case of valve 6 being open, pressurized air may be fed via pipe 27 to the two vessels I and II, and such vessels may be blown out in this manner with the valve 10 being closed and valves 7 and 8, respectively, being opened.

The pressure pipe 26 for the cooling agent to be disposed of is at the side of valve 5 remote from the vessel connected to the pipe for pressurized air 27 supplying pressurized air of a pressure of about 7 bar, via a pipe 33. Therein, the mouth portion of the pressurized air pipe 33 is formed as injector issuing its pressurized air stream in direction to the vessel I and being capable of generating a partial vacuum of about 40 mbar in the pipe 26 at the side remote from the vessel.

Thereby it is assured that coolant leaking out upon tapping of a coolant pipe under pressure, is evacuated into the pressure vessel I and does not reach the environment.

The pressure pipe 26 for the cooling agent to be disposed of further comprises a valve 3 and is further continued to the second adapter 22 which is connected to the refrigerating system to be evacuated. Said adapter 22 may be a vise-grip wrench member, e.g., with a thorn mounted movably thereon, which thorn is pressed through a rubber seal member into the coolant pipe to be tapped with the aid of a pressure nut, as is described in the above-cited patent application with the same filing date.

Between the injector 12 and the valve 3 a pipe 25 with a valve 2 branches from pipe 26. Said pipe 25 ends in pipe 24 connecting the first adapter 21 to the pressurized air pipe of the compressor 23 for the purpose of connection to the refrigerating system. Between the point where pipe 25 enters pipe 24 and the point of branching from the pressurized air pipe supplying a pressure of 18 bar, a first valve 1 is disposed, by means of which, in case of valve 2 being closed, pressurized air can be fed through pipe 24 and the adapter 21 to the refrigerating unit to be emptied, the cooling agent thereby reaching the vessel I through the adapter 22 and the line 26. Valve 1 preferably is a time-controlled magnetic valve being adjusted to a period of time being sufficient for completely blowing out all common absorption-type systems, e.g. about ten minutes.

The plant according to the present invention is operated as follows.

At first the vessel II is filled with water up to about one half. This may be checked with the aid of an inspection glass 39. The valves 1 to 8 are closed during this operation, valves 9 (fresh water supply) and 10 (deaeration) are opened.

For pressure relief of a refrigerating unit to be emptied the adapter 21 is disposed at the refrigerating unit, preferably close to the storage reservoir, and the pipeline system is opened by means of the tapping means incorporated in the adapter. To make the pressure of about 25 bar to escape into the pressure vessel I, valves 1 and 3 as well as 6 to 9 are closed and valves 2, 4, 5 as well as 10 are opened; thereby providing a flow path comprising pipes 24, 25 and 26 leading into the pressure vessel. Through pipe 33 and valve 4 pressurized air of about 7 bar reaches the injector 12 and produces a slight amount of suction in pipe 26, whereby it is assured that the hydrogen escaping from the tapped refrigerating unit with its fraction of saturation of ammonia reaches vessel I and from there further reaches the water supply of vessel II, where the major part of the ammonia vapor is absorbed and the hydrogen reaches the atmosphere through the air-outlet pipe 31 and the opened valve 10.

After the pressure balancing having been effected, the adapter 22 is disposed in the area of the water separator/condensor of the refrigerating unit.

For blowing out the cooling agent into the pressure vessels I and II, valves 1, 3, 5 and 10 are opened and valves 2, 4 and 6 to 9 are closed. Thereby, a stream of pressurized air of about 17 l/s and 18 bar is fed to the refrigerating unit. In case of a time controlled magnetic valve 1 as a rule a defined interval of time of 10 minutes is sufficient for emptying the refrigerating unit.

The cooling agent is flushed through pipe 26 and the opened valves 3 and 5 into the pressure vessel I, while the air stream containing ammonia is lead through the water supply in vessel II, where the major fraction of ammonia is absorbed and the purified air reaches, the atmosphere through pipe 31 and valve 10. The majority of the chromate fraction contained in the coolant together with the cooling agent remain in the pressure vessel I; a small portion is carried along with the pressurized air into the vessel II, where it is separated in the water supply. The exhaust air leaving through pipe 31, for this reason, contains chromate particles in a concentration below the amount admissible.

After about 80 to 100 blowing-out operations the vessels I and II are filled to such extent or, respectively, saturated with ammonia vapor that a further evacuation therewith is no longer possible. For emptying the vessels valves 1 to 5 as well as 9 and 10 are closed, and one of valves 7 and 8 is opened so that the vessel I can be charged with pressurized air through pipe 27 and valve 6. With valve 7 being open, vessel I is emptied through valve 7 and pipe 28 into the collective reservoir vessel for waste of this kind. With valve 7 being closed and valve 8 being open, the pressure vessel II is emptied through pipe 32 into the collective reservoir.

It is advantageous for the operation of the plant according to the present invention to connect the adapter 21, 22 and the compressor 23 with the plant according to the invention via rapid-action-type hose connections. Correspondingly the collective reservoir vessel for the collected coolant may be connected through a rapid-action type coupling, wherein in this case a transparent hose pipe facilitates surveillance of the decantation process.

FIG. 2 shows a pressure vessel plant according to the present invention in front view. The two pressure vessels I and II are mutally connected in above-described manner through connection pipe 29. Vessel II includes a pressure gauge 35 as well as valve 10 with a waste air pipe 31 at the top end. The pressure-relief pipes of the pressure-relief valves 36, 37 (hidden) end in the waste air pipe 31.

In the bottom of vessels I and II drain pipes 28 and 32 with valves 7, 8 (hidden) are located. Vessel II in addition comprises a fresh water supply 30 with a stopcock 9 and non-return valve 13.

Both vessels I and II include inspection glasses 39 permitting a checking of the liquid level.

The pressurized air is fed through pipe 24. The latter leads through pipe 27, the throttle-type valve 11, the pipe 33, the valve 4 and the injector 12 into the pipe 26 leading into the vessel I after having passed valve 5.

Pipe 24 leads through valve 1 to a rapid-action-type hose connection 41 through which it then is continued as pressure hose 24 to the first adapter 21. Pipe 25 via valve 2 connects pipe 24 to pipe 26 and the vessel I.

The second adapter 22 is connected with the aid of a hose by means of a rapid-action-type hose connection 42 to pipe 26 with valve 3. For blowing out a refrigerating unit it is operable to send pressurized air through pressure pipe 24 with opened valve 1 and closed valve 2 via the rapid-action-type hose connection 41, a pressure hose 24 connected thereto and the adapter 21 to the refrigerating unit to be emptied, so that the cooling agent is forced through the adapter 22, the rapid-action-type hose connection 42, the valve 3, the pipe 26 and the opened valve 5 into vessel I. Valves 2 and 4 are closed.

Pressurized air pipe 27 ends in the vessel I via valve 6, which vessel may thus be emptied through pipe 28 with the valve 7 being opened and valve 10 being closed.

Pipes 26 and 27 preferably end in the vessel in tangential manner for avoiding splashing.

FIG. 3 shows a top view of the apparatus according to the present invention of FIG. 2. Pressure vessels I and II, being sealed at their top ends in traditional manner, each comprise a pressure gauge 34, 35 as well as pressure-relief valves 36 and 37 which are connected to the exhaust air pipe 31 through a conduit. The exhaust air pipe 31 includes a valve 10. The two vessels I and II are in mutual connection through the connection pipe 29. Inspection glasses 39 permit a checking of the liquid level.

FIG. 4 shows a section along pipe A—A through the plant of FIG. 2 according to the present invention. Vessels I and II are in connection through the connection pipe 29 (partly shown). Pipe 26 leads via the injector 12 and the valve 5 tangentially into the vessel I; the pressure pipe 27 leads through valve 6 also tangentially into said vessel. In a plane located therebelow, pressure, coolant and waste air pipes are disposed together with the relating valves.

Vessel II is provided with fresh water through pipe 30 and valve 9, wherein a non-return valve 13 inhibits the backflow of water from the vessel possibly charged with pressure, to the pipe. It is as well possible to provide a tube separation element instead of the non-return valve, such element consisting of a magnetic valve as well as of a component combining the functions of a return stop member and an overflow member. The magnetic valve blocks the fresh water supply during operation, the return flow blocking member inhibits a backflow of dirty water into the fresh water pipe, and the water between the magnetic valve and the return flow blocking member can be removed with the aid of a overflow member built in the manner of a siphon, so that a mixing of fresh water and dirty water is avoided.

Both vessels I and II are equipped with inspection glasses 39 for checking the liquid level.

Vessel II in addition comprises in its interior a circular pipe 38 in which pipe 29 ends. Said ring pipe includes a plurality of perforations directed downwardly or, respectively, slanting downwardly, said perforations permitting the exit of the gas having entered through pipe 29, below the water level in vessel II. This renders possible the absorption of ammonia and the washing out of chromate.

FIG. 5 is a side view of the pressure vessel I of FIG. 2 used in accordance with the present invention, comprising a pressure gauge 34, a pressure-relief valve 36 and a drain pipe 28 with valve 7. In the background drain pipe 31 is indicated, in the front part parts of the pipe system connected.

The plant according to the present invention is particularly suitable for being used as mobile unit. For this purpose it may be mounted on a vehicle member or on a truck.

What is claimed:

1. Apparatus for evacuating and disposing of the coolant of absorption-type refrigerating systems, the cooling agent of which contains an auxiliary gas, water as solvent as well as a corrosion inhibitor, comprising a first and a second adapter for connection of the refrigerating system to be emptied, an air compressor or pressurized air connection member connected to said first adapter via a blockable pressurized air pipe and a relating valve, a first pressure vessel being in connection with said second adapter via a blockable pressure pipe and relating valves and comprising an outlet with a valve for the liquid collected in the vessel, a second pressure vessel connected to said first pressure vessel via a connection pipe and comprising a fresh water supply, a waste air pipe as well as an outlet with a valve, wherein said connection pipe starting from the top end of said first pressure vessel, ends into the lower half of said second pressure vessel and wherein for emptying the refrigerating system, said second pressure vessel is filled with water up to about one half and the valves are opened.

2. Apparatus as defined in claim 1, wherein an injector being in connection with said compressor or pressurized air connection member via a valve and a pressurized air pipe is disposed in said pressure pipe connecting said second adapter with said first pressure vessel.

3. Apparatus as defined in claim 2, wherein a throttle-type valve is arranged in said pressurized air pipe.

4. Apparatus as defined in claim 2, wherein a second valve is disposed in said pressure pipe connecting said first pressure vessel with said second adapter, wherein said pressure pipes between said two adapters and said first pressure vessel are lead together behind the valves, and wherein the injector is disposed in the common part before the valve.

5. Apparatus as defined in claim 4, wherein said second valve in the pressure pipe is a time-controlled magnetic valve.

6. Apparatus as defined in claim 1, wherein the connection pipe ends in a gas distributor in said second vessel.

7. Apparatus as defined in claim 6, wherein said gas distributor is a horizontal ring pipe with gas outlet openings directed downwardly.

8. Apparatus as defined in claim 1, wherein the waste air pipe includes a valve and wherein for blowing out said vessels, a separate pressurized air pipe is guided into said first vessel through a valve.

9. Apparatus as defined of claim 1, wherein it is mounted so as to be movable.

* * * * *